United States Patent [19]

Kohno

[11] 4,321,796

[45] Mar. 30, 1982

[54] APPARATUS FOR EVAPORATING ORDINARY TEMPERATURE LIQUEFIED GASES

[75] Inventor: Norihiko Kohno, Mitaka, Japan

[73] Assignee: Kobe Steel, Limited, Kobe, Japan

[21] Appl. No.: 163,577

[22] Filed: Jun. 27, 1980

[30] Foreign Application Priority Data

Jun. 28, 1979 [JP] Japan ..... 54/82209

[51] Int. Cl.[3] ..... F17C 7/02

[52] U.S. Cl. ..... 62/52

[58] Field of Search ..... 62/50, 51, 52; 122/13

[56] References Cited

U.S. PATENT DOCUMENTS

| | | | |
|---|---|---|---|
| 2,234,407 | 3/1941 | Hoagland | 62/52 |
| 2,432,546 | 12/1947 | Tanner | 62/7 |
| 2,449,118 | 9/1948 | Holicer | 62/51 |
| 2,459,974 | 1/1949 | Turner | 62/52 |
| 2,535,148 | 12/1950 | Martin | 48/190 |
| 2,705,872 | 4/1955 | Thompson | 62/52 |
| 2,747,374 | 5/1956 | Thompson | 62/51 |
| 2,793,654 | 5/1957 | Biermann | 137/434 |
| 2,993,343 | 7/1961 | Benz | 62/48 |
| 3,034,529 | 5/1962 | Kittler | 137/315 |
| 3,407,787 | 10/1968 | Golden | 122/4 |
| 3,578,753 | 5/1971 | Freeman, Jr. | 62/51 |
| 4,175,395 | 11/1979 | Prost et al. | 62/52 |

*Primary Examiner*—Ronald C. Capossela

*Attorney, Agent, or Firm*—Oblon, Fisher, Spivak, McClelland & Maier

[57] ABSTRACT

An apparatus for evaporating ordinary temperature liquefied gases. The apparatus includes an ordinary temperature liquefied gas storing vessel, an evaporating chamber for evaporating a liquefied gas, and a liquid level detecting chamber for detecting the liquid level in the evaporating chamber. The detecting chamber is disposed between the storage vessel and the evaporating chamber. The liquid outlet from the storage vessel and detecting chamber are connected together by a conduit equipped with a liquid pressure reducing valve, the bottom of the detecting chamber and the liquid inlet to the evaporating chamber are connected together by a liquid conduit, and the respective gas outlets from the detecting chamber and evaporating chamber are connected to a gas warming chamber.

4 Claims, 2 Drawing Figures

APPARATUS FOR EVAPORATING ORDINARY TEMPERATURE LIQUEFIED GASES

BACKGROUND OF THE INVENTION

1. Field of the Invention

The present invention relates to an apparatus for evaporating ordinary temperature liquefied gases for stabilized supply, and more particularly relates to an evaporating apparatus designed to avoid accidents in which part of such liquefied gas is supplied in liquid form. In addition, the term "ordinary temperature liquefied gases" refers to liquefied petroleum gas (hereinafter abbreviated to LPG), chlorine gas, carbon dioxide gas and other gases which are liquefied at ordinary or low temperatures. Hereinafter, reference will be made to LPG taken up as representative.

2. Description of the Prior Art

LPG is utilized as fuel for homes, offices, firms, etc. The gas supplying system differs with the amount of gas to be used and with LPG composition, a simple example being one of which the gas phase in the vessel is extracted for supply and when the amount of gas to be used is large, a number of vessels are used to supply gas. If the amount of gas to be used is larger, a separately prepared vaporizer is used for forced vaporization by an electric heater or other heat source to supply gas. Thus, when the amount of gas to be used is relatively large as described, it has been necessary to prepare a number of vessels or use a large amount of electricity, which is not economical. However, it is unnecessary to secure any special heat source for vaporizing LPG since it is possible to make use of the atmosphere, sea water, river water, industrial water, underground water, hot waste water and other heat sources providing nearly natural heat, which are economical. These heat sources, however, are difficult with respect to manual control thereof. If, therefore, the temperature of the natural heat source abnormally lowers below a predicted value or the vaporizer becomes overloaded as by an abnormal increase in gas consumption, some of the LPG introduced into the vaporizer cannot vaporize and flows out of the vaporizer into the piping extending therefrom where it vaporizes under the influence of heat from the surroundings to exert a pressure abnormally higher than the planned pressure, or the liquid spouts at the terminal place of use.

Further, LPG is a mixture of propane, butane, etc., and butane (whose boiling point at atmospheric pressure is 0° C.) is particularly difficult with respect to evaporation. Therefore, when the atmosphere or other heat source providing nearly natural heat is used, a problem occurs in that butane remains in the vaporizer or in the case of an evaporating chamber having a plurality of juxtaposed flow passages, such locally collects, interferring with uniform feeding of fresh LPG. As a result, part of the evaporating chamber loses its evaporating capacity, causing a decrease in the overall capacity or in the outlet temperature or sometimes even causing an accident in outflow of liquid.

As LPG is vaporized and consumed for a long period of time, a small amount of foreign matter, including heavy substances, contained in LPG accumulates in the evaporating chamber, which foreign matter must be periodically discharged. In the case of an evaporating apparatus of the type which requires a fixed amount of LPG to be stored at all times during evaporation, discharge of the drain including heavy substances entails outflow of a large amount of effective components, causing a large gas loss.

SUMMARY OF THE INVENTION

With the above in mind, the present invention has for its object the provision for an apparatus capable of eliminating the above disadvantages. The arrangement of the present apparatus achieving such object has a first gist consisting in the provision of a liquid level detecting chamber for detecting the liquid level in an evaporating chamber, such liquid level detecting chamber being disposed between an LPG storing vessel and the evaporating chamber. A conduit equipped with a liquid pressure reducing valve is installed between the liquid outlet from the storage vessel and the liquid level detecting chamber so that a mixture of liquid and gas from partly vaporized LPG can be introduced into the liquid level detecting chamber after liquid pressure reduction and this constitutes a second gist. A third gist consists in the fact that the bottom of the liquid level detecting chamber and the liquid inlet to the evaporating chamber are communicated with each other by a liquid conduit, with their respective gas outlets being independently or collectively connected to a gas warming chamber. It is to be understood that changes of design or modifications may be made in these gists so long as they do not run counter to the spirit of the invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
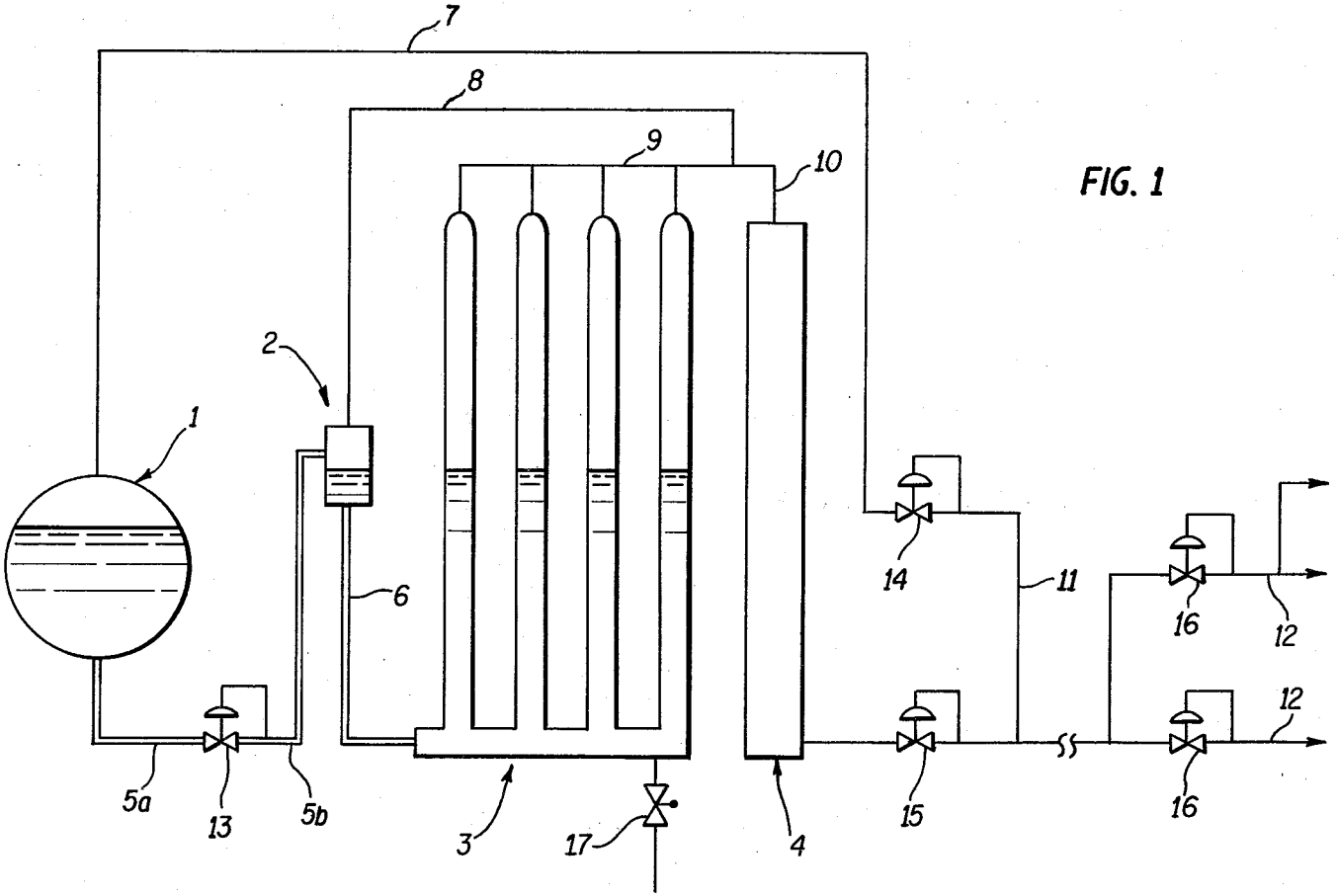
FIG. 1 is a flow chart illustrating an embodiment of the present invention.

In the drawings, reference numeral 1 denotes an LPG storing vessel; 2 denotes a liquid level detecting chamber; and 3 denotes an evaporating chamber. Of the conduits connecting them together, double lines **5*a* and 6 are for liquid conveyance, a thick line 5*b* for gas-liquid mixture conveyance, and thin lines or conduits 7–12 for gas conveyance. Reference numeral 13 denotes a liquid pressure reducing valve (expansion valve); 14 and 15 denote feed gas pressure regulators; 16 denotes terminal pressure regulators; and 17** denotes a drain valve.

The storage vessel 1 and the liquid level detecting chamber 2 are connected together by the conduits **5*a* and 5*b*, with the intervening liquid pressure reducing valve 13 dividing the line system into a liquid conveying line in the front and a gas-liquid mixture conveying line in the rear. Since LPG is an ordinary temperature liquefied gas, such is stored under high pressure in the storage vessel 1 and is in liquid phase even in the conduit 5*a*, but when the pressure in the conduit is reduced by the liquid pressure reducing valve 13, part of LPG is evaporated by its self-heating characteristic, so that a gas-liquid mixture from LPG is conveyed through the conduit 5*b* into the liquid level detecting chamber 2**.

Figure 2:
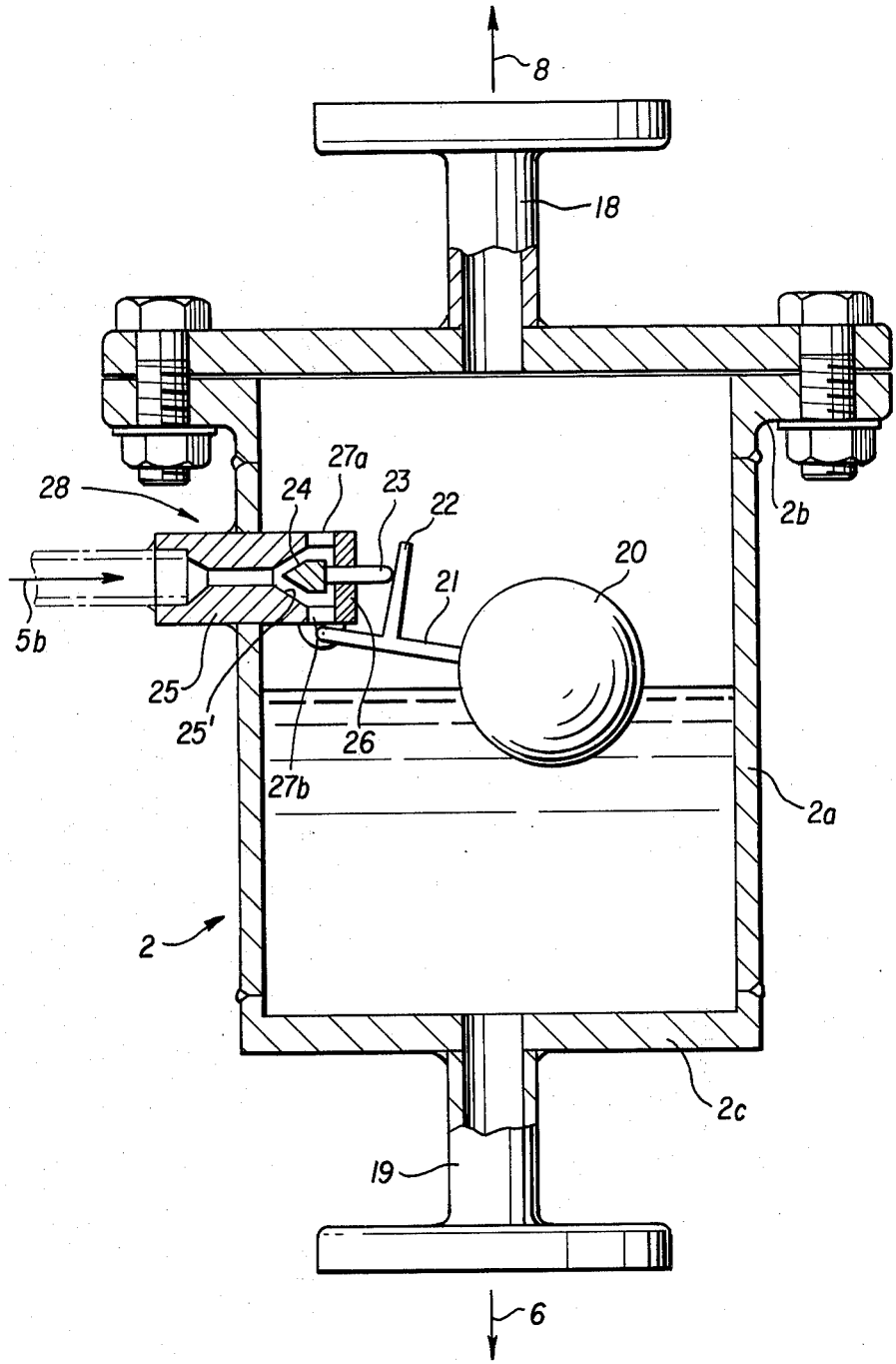
FIG. 2 is a sectional view, showing an example of a liquid level detecting chamber.

The arrangement of the liquid level detecting chamber does not restrict the present invention and various designs may be made as desired. A typical example of such arrangement is shown in FIG. 2. The device shown in FIG. 2 is of the float type, including a cylindrical section 2*a*, an upper flange section 2*b*, and a bottom plate section 2*c*, such sections being welded into a unit, with flanges 18 and 19 attached thereto. The cylindrical section 2*a* has a valve unit 28 connected thereto, such valve unit being connected to the conduit 5*b*, with the flanges 18 and 19 being connected to the gas conduit 8 and liquid conduit 6, respectively.

The valve unit 28 includes provision for a valve box 25 and a float 20 which are connected together by an arm 21, which is pivotally connected to the valve box 25. The front end of the valve box 25 is covered with a lid plate 26 and is formed with communication holes 27*a* and 27*b*. The lid plate 26 has a valve stem 23 slidably inserted therein, and the inside end of the valve stem is formed with a tapered closure valve 24, the taper thereof being of the same size as a taper 25' formed on the inner surface of the valve box 25 in opposed relation thereto. The arm 21 is formed with a branch arm 22 adapted to abut against valve stem 23. Therefore, when the liquid level in the chamber begins to fall, the float 20 tends to descend, with the branch arm 22 leaving the valve stem 23, so that the closure valve 24 is forced to the right as seen in FIG. 2 by the pressure from the conduit 5*b*. As a result, the gas and liquid coming in from the conduit 5*b* pass through the valve box 25 and enter the chamber via the communication holes 27*a* and 27*b*. Conversely, when the liquid level in the chamber begins to rise, the float 20 tends to ascend, with the branch arm 22 pushing in the valve stem, so that the taper surface of the closure valve 24 is pressed against taper 25' thereby preventing the inflow of LPG. In addition, the illustrated float type performs the two functions of a liquid level detector and an inflow control, but a different arrangement may be utilized so that these functions are performed by separate devices.

Thus, a mixture of gas and liquid enters the liquid level detecting chamber 2 and is separated into the two components owing to the difference in their densities, such that the liquid underlies the gas. As is clear, the bottom of the liquid level detecting chamber 2 is in communication with the bottom of the evaporating chamber 3 by the liquid conduit 6. Therefore, as LPG in liquid phase in the evaporating chamber 3 vaporizes and is consumed, the evaporating chamber is supplied with LPG, while LPG in gas phase is discharged by the gas conduit 8 and meets (as at line 10) the gas coming up from the top of the evaporating chamber 3 through the gas conduit 9 and flows together with the gas into the warming chamber 4 or without meeting, they independently flow into the warming chamber 4 where the gas is heated approximately to atmospheric temperature. The gas has the warming chamber flows through the feed gas pressure regulator 15 to the terminal consumption section and then to consumption tubes 12 via the terminal pressure regulators 16. In addition, the gas phase region of the storage vessel 1 has the gas conduit or bypass 7 connected thereto so that the gas evaporating directly from the vessel 1 is fed to the terminal consumption section via the feed gas pressure regulator 14 and gas conduit 11. If necessary, a change of design may be made so that all or part of the gas in the gas conduit 7 is introduced into the warming chamber 4 or so that part of the gas in the gas conduits 8, 9, 10 is directly fed into the terminal consumption section without being introduced into the warming chamber 4.

With the apparatus arranged in the manner described above, if the liquid level in the evaporating chamber 3 abnormally rises, the liquid level detecting chamber 2 detects it to prevent inflow of LPG. Therefore, accidents of LPG in liquid phase spouting owing to such abnormal rise can be avoided, but this is not the only effect of the present invention. Rather, the present invention has other effects as follows.

As is known in the art, the float type valve has the function of a liquid pressure reducing valve. For example, it is known to make use of a low pressure float valve to control the liquid level in an evaporating chamber so as to prevent the flow of a refrigerant into a refrigerator. In the present apparatus, therefore, it would not be impossible to omit the liquid pressure reducing valve 13 while achieving such effect by the float valve. In order to achieve such effect by the float valve, however, it is necessary to store a fixed amount of liquid at all times in the evaporating vessel 3. Since LPG is a liquefied gas which is a mixture of propane, butane, etc., and butane (whose boiling point at atmospheric pressure is 0° C.) is particularly difficult to evaporate, if the atmosphere or other heat source providing nearly natural heat is used as the heating source, butane remains in the vaporizing device or if an evaporating chamber having a plurality of juxtaposed flow passages is used, it locally collects. For example, in the evaporating chamber 3 with four parallel flow passages, as shown in FIG. 1, the phenomenon is noticeable especially in the innermost (or rightmost) flow passage, causing various problems including one in which fresh LPG is not uniformly supplied. As a result, a part of the evaporating chamber loses its evaporating capacity, causing a decrease in the overall capacity.

Further, as LPG is vaporized and consumed for a long period of time, a small amount of foreign matter, including heavy substances, contained in LPG accumulates in the evaporating chamber, which foreign matter must be periodically discharged. In FIG. 1, for example, it is discharged by opening the drain valve 17. Since a fixed amount of liquid is stored at all times in the evaporating chamber 3, as described above, there is a problem that a large amount of effective components is discharged together with the drain, causing a large gas loss.

It is known in the liquefied gas plant industry that an ordinary temperature liquefied gas is reduced in pressure by a liquid pressure reducing valve (expansion valve) to supply the resulting mixture of gas and liquid directly to an evaporator, the use of such liquid pressure reducing valve being inevitable when a heat source providing nearly natural heat is utilized. However, supplying the gas-liquid mixture, reduced in pressure by a liquid pressure reducing valve, directly to an evaporator encounters the following problem.

This situation means that in FIG. 1 the liquid level detecting chamber 2 and gas conduit 8 are omitted and that the liquid conduit 6 is connected to the conduit 5*b* so that a gas-liquid mixture flows directly into the evaporating chamber 3, with some mechanism, though not described in detail, being provided for preventing outflow of liquid. When a predetermined amount of liquid has collected in the evaporating chamber 3, the gas portion of a freshly supplied gas-liquid mixture has its way blocked so that, for example, as shown in FIG. 1, even in the case of the evaporating chamber 3 having four parallel flow passages, the gas portion tends to concentrate in the flow passage nearest to the inlet (the leftmost one in FIG. 1). As a result, the liquid is carried by the gas and rises higher than in the other flow passages and in an incompletely evaporated state such is fed into the warming chamber 4, with the result that the outlet temperature becomes extremely low or sometimes even an accident of out-flow of liquid is caused. In this case, as in the case of the float valve having the function of a pressure reducing valve, the butane component, which is difficult to evaporate, locally accumulates, thus causing a decrease in the overall evaporating capacity.

In contrast, according to the present invention, an ordinary temperature liquefied gas is reduced in pressure by the liquid pressure reducing valve 13 and the resulting gas-liquid mixture is introduced into the liquid level detecting chamber 2 where it is separated into liquid and gas which are then supplied to the evaporating chamber 3 and the warming chamber 4, respectively. Therefore, the liquid being fed through the liquid conduit 6 is at low temperature so that only a small part of the liquid vaporizes when it is passing through liquid conduit 6, thus avoiding the above-described disadvantage which occurs where the liquid is reduced in pressure by the liquid pressure reducing valve 13 and the resulting gas-liquid mixture is fed directly to the evaporating chamber 3. The float valve operates only when such overload condition takes place. Thus, during normal operation, it is substantially unnecessary for the float valve to operate and LPG is supplied exclusively by the action of the liquid pressure reducing valve 13. The liquid pressure reducing valve 13 communicates with the evaporating chamber 3 and with the liquid level detecting chamber 2 and is set so that it opens if the pressure in the conduit **5*b*, which is approximately the same as the pressures in the chambers is lower than the predetermined reduced pressure and closes if it is higher than the last-mentioned pressure. The consumption of gas in multiple dwelling houses and in firms greatly varies with the time zone. If the amount of gas being used is small, it is exceeded by the evaporating capacity, thus making it possible to minimize the amount of liquid remaining in the evaporating chamber 3**, ensuring a sufficiently high vaporizing capacity needed for the evaporator to evaporate the high boiling point components, such as butane, for consumption.

Since the residual concentration of impurities and heavy substances increases, the opening of the drain valve 17 will allow them to discharge in an enriched state, thus minimizing the disadvantage of wasting the effective components of LPG. Therefore, in the illustrated embodiment, supply of LPG to the evaporating chamber 3 is controlled almost exclusively by the liquid pressure reducing valve 13. It is not until an abnormal rise in the liquid level is caused by insufficient evaporation in the evaporating chamber 3 due to overload as caused by an abnormal drop in atmospheric temperature or abnormal rise in the gas consumption that the float valve operates to prevent inflow of LPG. If the float valve closes, the pressure in the conduit **5*b* increases and the liquid pressure reducing valve 13** closes.

Even during overload, evaporation in the evaporating chamber 3 continues, and when the liquid level falls, the float valve opens to release the pressure in the conduit **5*b* to open the liquid pressure reducing valve 13. In this manner, in an overloaded condition, the float valve and the liquid pressure reducing valve 13 perform their respective opening and closing operations to prevent the liquid level in the evaporating chamber 3 from exceeding a certain limit. However, there is a limit to the supply of gas from the evaporator. If the pressure on the terminal end side drops below a predetermined value, feeding of gas from the gas conduit 7 is accomplished, thereby maintaining the stabilized supply condition. Thus, feed gas pressure regulator 14 opens upon detection of the supply of gas becoming insufficient as the pressure on the terminal end side drops below the predetermined value. During the time period in which the overload condition is present, the feed gas pressure regulator 14 performs an opening and closing operation to regulate the supply of gas so as to prevent the pressure on the terminal end side from dropping below the predetermined value. When the overload condition is over, the feed gas pressure regulator 14 closes upon detection of the pressure on the terminal end side being restored to the predetermined value, so that feeding of gas from the gas conduit 7 is stopped, with the liquid level in the evaporating chamber 3** gradually lowering. Thus, with the float valve kept open, supply of LPG is started again by the liquid pressure reducing valve alone.

The arrangement, function and effectiveness of the present apparatus are described thus far, but, as already pointed out, various changes of design are possible. For example, the liquid level detecting chamber 2 and liquid conduit 6 may be heat-insulated to prevent vaporization in these parts or the liquid pressure reducing valve 13 may be so designed that it opens and closes in response to the pressure in the gas phase region of the liquid level detecting chamber 2, evaporating chamber 3 or warming chamber 4. In the latter case, however, as compared with the embodiment wherein it responds to the pressure in the conduit **5*b***, only the operation in the overloaded condition somewhat differs. In the overloaded condition, the pressures in these parts are somewhat lower than in the normal condition time period, so that the liquid pressure reducing valve is somewhat biased toward the open side.

Since the present invention is arranged in the manner described above, the effects are summarized below are achieved.

(1) Restoration of vaporizing capacity is possible by making use of the fact that gas consumption varies with time zone.

(2) In the case of a mixed gas, localized accumulation of the high boiling point components in the evaporating section is prevented, so that there is no possibility of the evaporating section partly losing its evaporating capacity.

(3) An abnormal rise in liquid level due to localized supply in the evaporating section is prevented, so that there is no possibility of incompletely evaporated liquid flowing into the subsequent section and the outlet temperature is constant.

(4) Flow of liquefied gas into the piping subsequent to the evaporating section is prevented, eliminating the danger of the pressure in the terminal consumption section becoming abnormally high or blowing out in a liquid state; and (5) A minimum of gas loss is involved in drainage.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for evaporating ordinary temperature liquefied gas, comprising:

a liquefied gas storage vessel;

at least one pressure reducing valve connected to said liquefied gas storage such that said liquefied gas is converted into a two phase liquid-gas fluid;

at least one liquid level detecting chamber connected to said pressure reducing valve, wherein said two phase fluid is separated into a first liquid phase and a first gaseous phase;

at least one evaporating chamber wherein said liquefied gas comprises a second liquid phase and a second gaseous phase;

means for directly connecting said first liquid phase from said liquid level detecting chamber to a lower portion of said evaporating chamber;

means for directly connecting said first gaseous phase from said liquid level detecting chamber to a point downstream from said second liquid phase of said liquefied gas within said evaporating chamber; and a flow control valve means associated with each said at least one liquid level detecting chamber operative in response to said liquid level detecting means.

2. The apparatus of claim 1 further comprising a warming chamber connected to the outlet of said evaporating chamber.

3. The apparatus of claim 2 further comprising first conduit means for connecting said warming chamber to said at least one evaporating chamber, wherein a portion of said conduit means is located at a point adjacent an upper portion of said at least one evaporating chamber.

4. The apparatus of claim 1 wherein said reducing valve further comprises means operable in response to a downstream pressure.

* * * * *

UNITED STATES PATENT AND TRADEMARK OFFICE

CERTIFICATE OF CORRECTION

PATENT NO. : 4,321,796

DATED : March 30, 1982

INVENTOR(S) : NORIHIKO KOHNO

It is certified that error appears in the above-identified patent and that said Letters Patent is hereby corrected as shown below:

In column 1, line 22, delete "of" before "which" and insert therefor --in--;

In column 3, line 57, delete "has" and insert therefor --from--;

In column 4, line 21, delete "Since" before "LPG".

In column 4, line 24, delete "evaporate," and insert therefor --evaporate. Therefore,--;

In column 6, line 26, insert "as" before "described";

In column 6, line 38, delete "loaded" before "condition" and insert therefor --load--;

UNITED STATES PATENT AND TRADEMARK OFFICE

CERTIFICATE OF CORRECTION

PATENT NO. : 4,321,796

DATED : March 30, 1982

INVENTOR(S) : NORIHIKO KOHNO

It is certified that error appears in the above-identified patent and that said Letters Patent is hereby corrected as shown below:

In column 6, line 38, delete "overloaded" after "the" and insert therefor --overload--;

In column 6, line 44, delete "are" after "effects" and insert therefor --as--.

Signed and Sealed this

*Twentieth* Day of *December 1983*

[SEAL]

*Attest:*

GERALD J. MOSSINGHOFF

*Attesting Officer*

*Commissioner of Patents and Trademarks*